US011634980B2

(12) United States Patent
Le et al.

(10) Patent No.: US 11,634,980 B2
(45) Date of Patent: Apr. 25, 2023

(54) DOWNHOLE AND NEAR WELLBORE RESERVOIR STATE INFERENCE THROUGH AUTOMATED INVERSE WELLBORE FLOW MODELING

(71) Applicant: OspreyData, Inc., San Juan Capistrano, CA (US)

(72) Inventors: Chan Nhan Le, Ladera Ranch, CA (US); Venkataramana Balamurugan Srikanth Putcha, Vancouver (CA); Michael Ransom Pennell, San Clemente, CA (US)

(73) Assignee: OspreyData, Inc., San Juan Capistrano, CA (US)

( * ) Notice: Subject to any disclaimer, the term of this patent is extended or adjusted under 35 U.S.C. 154(b) by 0 days.

(21) Appl. No.: 16/905,345

(22) Filed: Jun. 18, 2020

(65) Prior Publication Data

US 2020/0400009 A1 Dec. 24, 2020

Related U.S. Application Data

(60) Provisional application No. 62/863,665, filed on Jun. 19, 2019.

(51) Int. Cl.
*E21B 47/008* (2012.01)
*E21B 47/024* (2006.01)
*E21B 47/06* (2012.01)

(52) U.S. Cl.
CPC ..... *E21B 47/008* (2020.05); *E21B 47/024* (2013.01); *E21B 47/06* (2013.01)

(58) Field of Classification Search
CPC ..... E21B 44/00; E21B 47/008; E21B 47/024; E21B 47/06

(Continued)

(56) References Cited

U.S. PATENT DOCUMENTS 5,444,619 A 8/1995 Hoskins
6,629,086 B1 9/2003 Lafargue
(Continued)

FOREIGN PATENT DOCUMENTS

CN 101255950 9/2008
RU 2256067 C2 7/2005
(Continued)

OTHER PUBLICATIONS

Pankaj, Piyush, et al. "Application of Data Science and Machine Learning for Well Completion Optimization." Offshore Technology Conference—OTC-28632-MS, May 2018. pp. 1-16.
(Continued)

*Primary Examiner* — Dany E Akakpo
(74) *Attorney, Agent, or Firm* — Fish IP Law, LLP

(57) ABSTRACT

A method to estimate the likely downhole conditions in the wellbore and reservoir by Inverse modeling well flow simulation history matched with field sensor data. The invention presents a method for automating sensor data processing through cleaning, transformation, and identification of stable states. This process is crucial for the selection of data to be simulated and matched without human review. The matched simulations are subjected to a state-space model in order to assign a probability to a given unknown state. This probability is updated at each time step. As the well undergoes transition over time including decline, the drift of the likely state of operation is orchestrated to allow physically constrained movement to a proximate space. Based on the extent of repetition and overlap between similar states as they transition over several time steps, the confidence of the inverse model increases, thus narrowing down the likely domain and trajectory of operation and boosting the probability of this narrowed zone. The knowledge of downhole and near wellbore reservoir zone is essential for better
(Continued)

Example: 2-D representation of a probability distribution at an initial stage modeling, understanding of the wells and decision making in the oilfield. This knowledge may be obtained through well testing but involves physical intervention that can involve expense and production loss. It is also less common to have such well tests being performed at a daily, weekly or even monthly basis so timely information is generally not available. This invention provides a mechanism to have a live update of such information without any physical intervention.

13 Claims, 3 Drawing Sheets

(58) Field of Classification Search
USPC ..... 166/250
See application file for complete search history.

(56) References Cited

U.S. PATENT DOCUMENTS

| | | | | |
|---|---|---|---|---|
| 6,724,687 | B1 | 4/2004 | Stephenson | |
| 6,901,391 | B2 | 5/2005 | Storm | |
| 7,054,752 | B2 | 5/2006 | Zabaza-Mezghani | |
| 7,818,071 | B2 | 10/2010 | Hartkamp | |
| 8,510,242 | B2 | 8/2013 | Al-Fattah | |
| 2004/0010374 | A1* | 1/2004 | Raghuraman | E21B 43/00 702/13 |
| 2004/0257240 | A1 | 12/2004 | Chen | |
| 2005/0246297 | A1 | 11/2005 | Chen | |
| 2009/0182693 | A1 | 7/2009 | Fulton | |
| 2010/0023269 | A1* | 1/2010 | Yusti | E21B 43/00 702/12 |
| 2011/0071963 | A1 | 3/2011 | Piovesan | |
| 2011/0313737 | A1* | 12/2011 | Hadj-Sassi | G06F 17/11 703/2 |
| 2013/0096898 | A1 | 4/2013 | Usadi | |
| 2013/0253837 | A1 | 9/2013 | Abitrabi | |
| 2015/0148919 | A1 | 5/2015 | Watson | |
| 2016/0259088 | A1* | 9/2016 | Carvajal | E21B 43/26 |
| 2016/0273315 | A1 | 9/2016 | Carvajal | |
| 2017/0364795 | A1 | 12/2017 | Anderson | |
| 2018/0320504 | A1* | 11/2018 | Gunnerud | E21B 41/00 |
| 2021/0222552 | A1* | 7/2021 | Gao | E21B 49/02 |

FOREIGN PATENT DOCUMENTS

| | | |
|---|---|---|
| RU | 111190 U1 | 12/2011 |
| WO | 2014197637 | 12/2014 |

OTHER PUBLICATIONS

Putcha, Venkataramana Balamurugan Srikanth. "Integration of Numerical and Machine Learning Protocols for Coupled Reservoir-Wellbore Models: A Study for Gas Lift Optimization." 2017. Pennsylvania State University, PhD dissertation.

Odedele T. O, et al. "Predicting Oil Well Gas Lift Performance and Production Optimization Using hybrid Particle Swarm Optimization and Fuzzy Support Vector Machines," Proceedings of the World Congress on Engineering, WCE 2016, London, U.K. vol. I. pp. 110-116.

Ibrahim_2016_Predicting_Oil_Well_Performance.

Pankaj_2018_Application_of_Data_Science.

Putcha_2017_Dissertation.

* cited by examiner

Example: 2-D representation of a probability distribution at an initial stage

Example: 2-D representation of a probability distribution after a few transitions Example: 2-D representation of a probability distribution at a mature stage

DOWNHOLE AND NEAR WELLBORE RESERVOIR STATE INFERENCE THROUGH AUTOMATED INVERSE WELLBORE FLOW MODELING

FIELD OF THE INVENTION

The field of the invention is modeling of downhole and near wellbore reservoir conditions.

BACKGROUND

The background description includes information that may be useful in understanding the present invention. It is not an admission that any of the information provided herein is prior art or relevant to the presently claimed invention, or that any publication specifically or implicitly referenced is prior art.

Downhole well conditions can be estimated through physical probe tests or by the placement of permanent downhole gauges. Enyekwe et al. (SPE-172435-MS) performed a comparative analysis of such downhole gauges, their strengths, and limitations. The reliability, accuracy, applicability of such downhole gauges is variable and conditional. It may not be commonplace to install these permanent downhole gauges due to these reasons in addition to the expense of purchasing and installation. Further, such gauges may be able to provide values for measurable physical parameters such as downhole pressure and temperature, but cannot provide an estimate of the near wellbore reservoir pressure or calculated parameters such as tubing friction factor and productivity index of a well.

The oil and gas community has used pressure transient analysis (PTA) for getting estimates of the averaged reservoir pressure and the skin factor near the wellbore. However, such PTA tests require a well shut-in operation. Alternatively, rate transient analysis (RTA) are able to estimate the averaged reservoir pressure, permeability, skin factor and other relevant variables through flowing well data and permanent downhole gauge data. Belyadi et al. (SPE-177293-MS) describes the applicability of modern RTA for unconventional shale reservoirs and explain the inaccuracy of decline curve analysis based methods which only require production data. Islam et al. (J Petrol Explor Prod Technol (2017) 7: 569. https://doi.org/10.1007/s13202-016-0278-y) have provided description and examples of various RTA methods utilizing the use of flowing bottom hole pressure and production data over time. To perform RTA at high frequency, this invention provides a method to estimate flowing bottom hole pressure data as an alternative to placing downhole gauges.

Numerical reservoir simulation has been used for analyzing the operating reservoir characteristics. Inverse modeling of reservoir simulations has been employed to estimate porosity, permeability, other reservoir parameters and their heterogeneity in layers of the reservoir. Such a process is based on averaged or approximated production rates from several wells over large periods of time. Rana et al. (ISSN 0098-3004, Computers & Geosciences, Volume 114, 2018, Pages 73-83, http://www.sciencedirect.com/science/article/pii/50098300417306076) describes an uncertainty quantification and history matching workflow using a Gaussian Process-Variogram Sensitivity (GP-VARS) while comparing its efficiency against Markov Chain Monte Carlo (MCMC) and Ensemble Kalman Filter (EnKF) methods for inverse modeling. As it can be observed in Rana et al., the frequency of production samples cited in the history matching of PUNQ-S3 reservoir is one sample per 300 days on average. In the current invention, the authors present a methodology for history matching and uncertainty quantification for assessing near wellbore reservoir pressures and downhole parameters such as productivity index of a well, tubing friction factor.

With the share of unconventional and shale-based oil production increased significantly in the recent time, the difference in reservoir pressure close to the wellbore when compared to the average reservoir pressure has become significant. Also, the well shut-in time required for estimating the reservoir pressure on an unconventional reservoir is significantly longer due to low permeability.

SUMMARY OF THE INVENTION

The current invention provides a methodology to obtain near wellbore reservoir pressures at a high frequency (e.g. daily when well operation is relatively stable) using inverse modeling of wellbore simulation. This approach contrasts it to the low-frequency reservoir simulation based inverse modeling approach which is impacted more by the aggregated reservoir conditions relatively farther away from the wellbore. To the best knowledge of the authors of the current invention, the effect of changes in the artificial lift set points on production rates is currently not included in the reservoir simulation based inverse modeling. Setpoint changes can be made on an artificial lift well at daily, weekly or other periodic interval, thus influencing the production rates of the specific well beyond the effects of the reservoir. These changes and the associated well performance results generate more information which can significantly improve the accuracy, but this information is not used on the approaches used this far. The current invention is expected to overcome these shortcomings.

Thus, there is still a need for improving machine learning approach by the automation of operations optimization, the isolation of special states to avoid interference, the usage of transfer learning based neural networks to generate high resolution, high-accuracy physically consistent well specific simulation and the adaptive learning through field implementation aspect of the current invention that are significantly different from the cited references.

SUMMARY OF THE INVENTION

The inventive subject matter provides apparatus, systems and methods for improved an automated machine process by operating data gathering, data simulation, data inverse modeling, and recommendation in a cyclical manner.

Various objects, features, aspects and advantages of the inventive subject matter will become more apparent from the following detailed description of preferred embodiments, along with the accompanying drawing figures in which like numerals represent like components.

DETAILED DESCRIPTION

Figure 1:
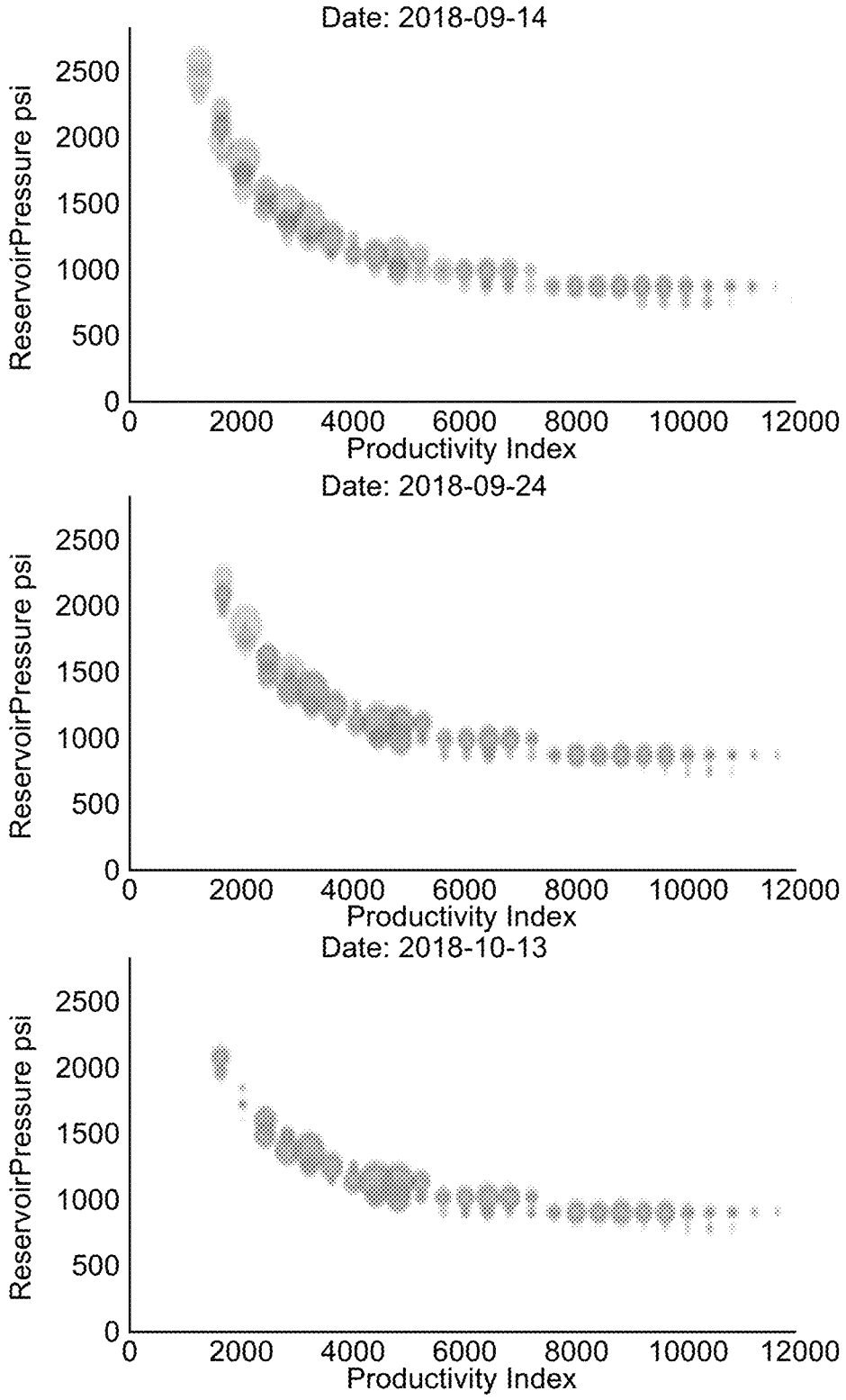
FIG. 1 is a collection of graphs showing probability distribution during the initial stages of a well's historical data.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

The workflow of the invention can be divided into the following steps:

Step 1—Identification of stable periods: The methodology in this invention is envisioned to be a completely automated process with the aim of minimizing manual intervention and bias while making the inverse modeling process scalable to a large number of wells through a software platform connected to live and historic feed of sensor data from the field. Thus, data points from the live and historic sensor feed which indicate instability are filtered out. This process is performed on a rolling basis for consistency of approach which is independent of the data being either historic or current. There can be several definitions of stability, one such embodiment is based on the comparison of the coefficient of variance (CV) in a rolling window with respect to the average CV in a look back period. Periods exceeding such a threshold in any of the recorded parameters is labeled as unstable and filtered out. Such a methodology differs from a typical outlier detection mechanism which is intended to filter out individual anomalies. This step of the current invention is focused on grouping points of stable periods together, rather than to identifying anomalies. One implementation of such a method includes the incremental accumulation of a stable period until a well undergoes a significant transition. This helps in isolating transitionary periods in a well.

Step 2—Simulation of possible states: For the first stable period for a given well, simulations are generated assuming a prior probability of downhole conditions, with additional inputs derived from the surface conditions obtained through sensor-based parameters. Such parameters will be referred to as surface parameters in the remainder of this document. In an alternative embodiment of the invention, the probability of associated surface parameters is weighted into the probability of the simulation case along with the probability of unknown downhole parameters. Since the process is to be scaled to several hundreds of wells, an approach to accelerate simulation through the usage of machine learning proxy for emulation of physics-based simulation as described in the patent (patent #1, Putcha et al.) is employed.

Step 3—Matching of simulation with field data: Of all the simulations generated for the first stable period, the cases which produce a response value within the range of operation of the response variables of the well are considered to be matched. History matching of simulation with field data can provide non-unique solutions. The purpose of probabilistic inverse modeling can be used to update the likelihood of each solution. The posterior probability of each likely state can be achieved through an update mechanism, one such embodiment being a Bayesian update resulting from the match. Subsequently, the process is applied to the next contiguous stable period to obtain the likelihood of each state in the state-space model. Each distinct stable period will be referred to as a time step in the subsequent portion of this document.

Figure 2:
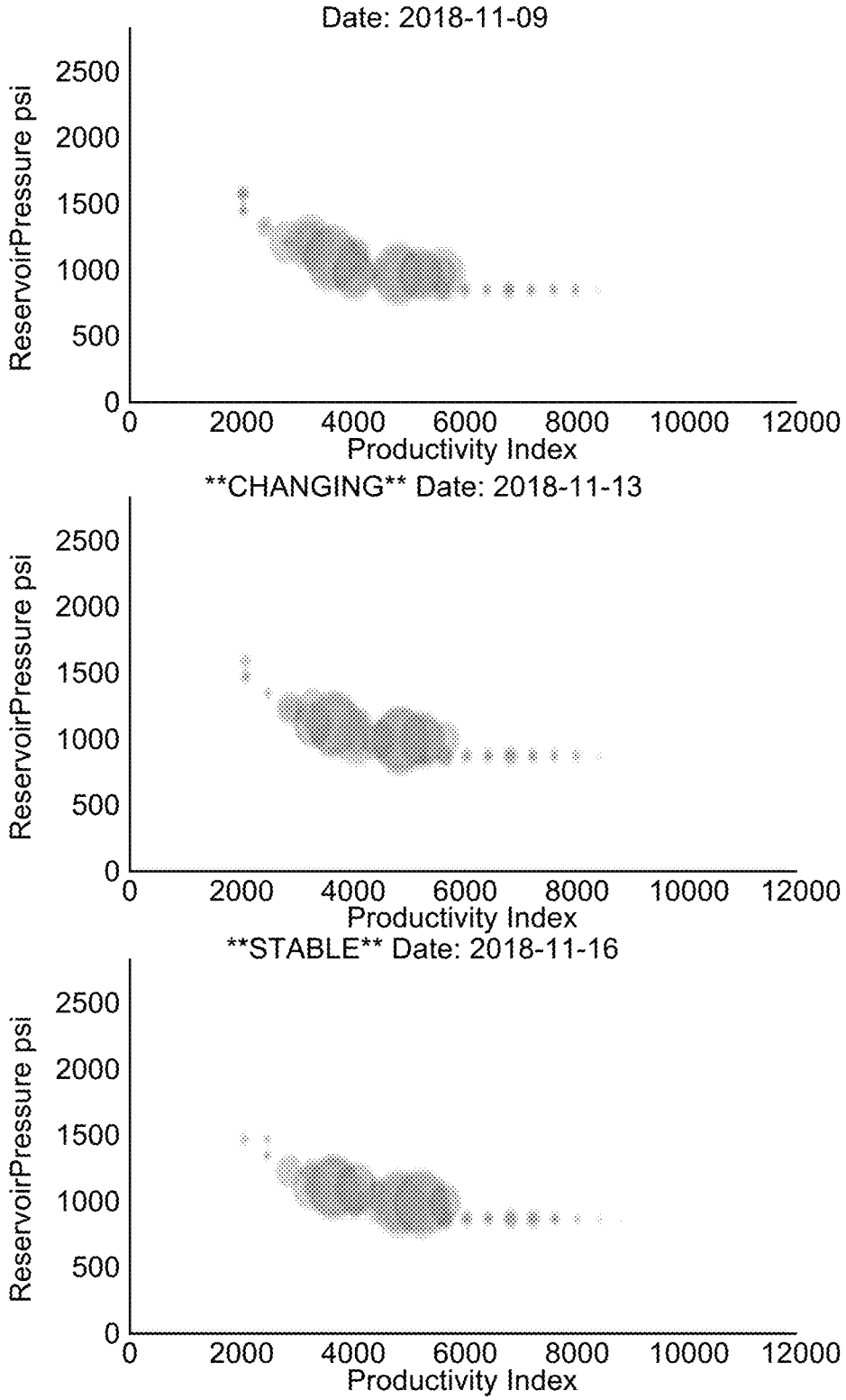
FIG. 2 is a collection of graphs representing an updated probability distribution after a few transitions.
Figure 3:
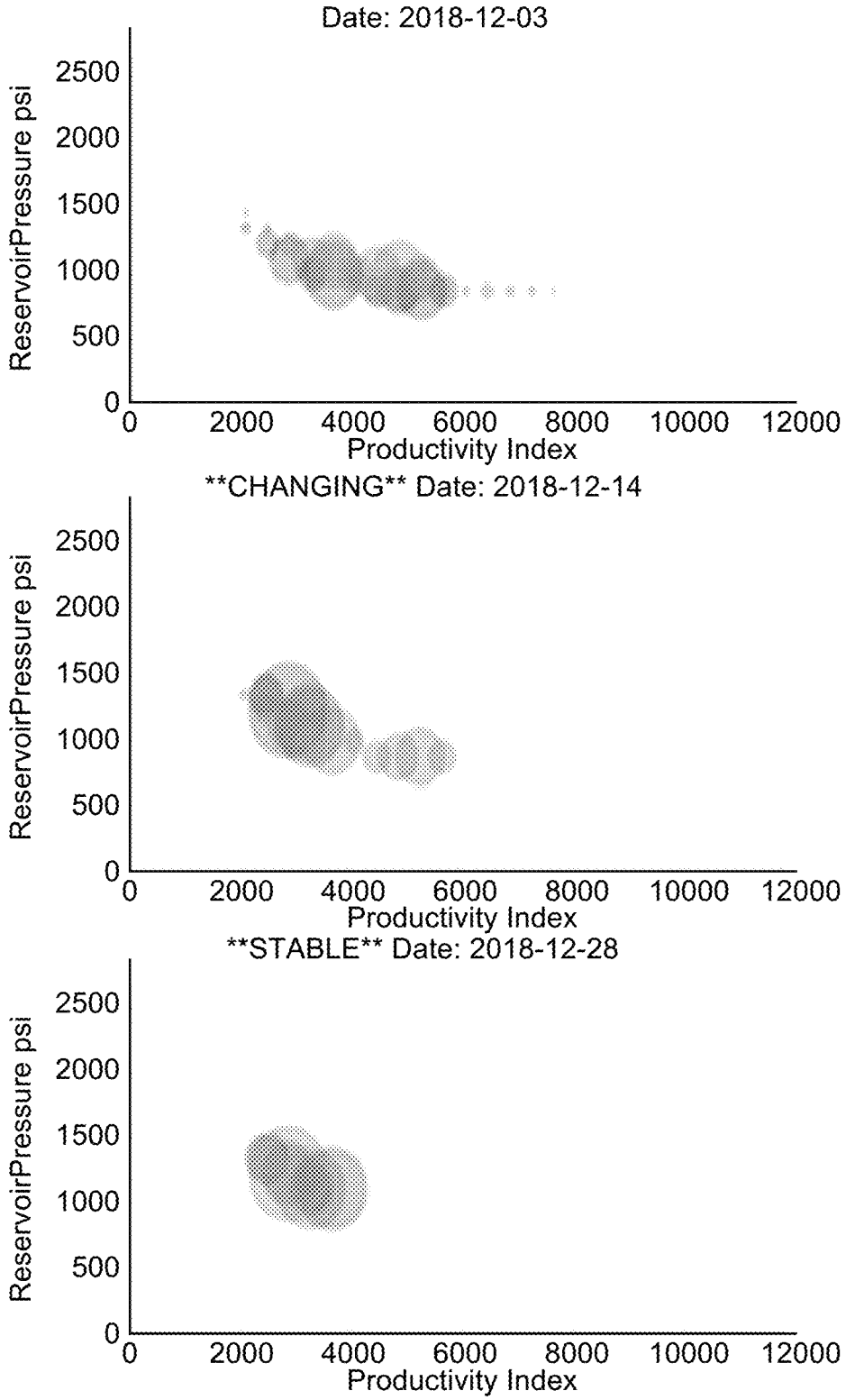
FIG. 3 is a collection of graphs representing probability distribution at a further mature state, where the model has grown further confident in narrowing down the likely operating state of the well to a very specific zone with a high probability.

Step 4—Drift Modeling: A well can transition due to various factors, some examples being, set points changes, workovers, re-stimulations, interference from other wells, decline due to depletion over time. Across a transition, it is possible to observe an overlap or a lack of it for each unknown state, where a state is defined as a unique case of the multidimensional combination of parameters. Based on the extent of such an overlap, the drift in the underlying probabilities of unknown states is estimated at each transition. The drift model is essential to estimate the transition. Since there is a physical limitation for the extent of the transition of the downhole and reservoir unknown conditions, the drift is restricted to contiguous states. Also, the direction of the drift is constrained to avoid unphysical changes in unknown parameters. These steps are implemented to accommodate natural or intervention induced transitions, for example. decline, re-stimulation of a well, while simultaneously ignoring transitions which may have occurred due to noisy data. Based on the reinforced overlap of a state across transitions, the model updates itself over time. FIG. 1-3 display the probability distribution on two-dimensional plot updating over time as an example implementation of this inverse modeling technique. The size of the bubble is representative of the underlying probability of a state. At a given time step, a green colored bubble indicates a migration towards a state, while a pink bubble indicates migration from a previous state. A brown bubble indicates an overlap of a state across contiguous time steps.

FIG. 1 is an example of a 2-D representation of a probability distribution at an initial stage. FIG. 1 represents the probability distribution during the initial stages of a well's historical data.

FIG. 2 is an example of a 2-D representation of a probability distribution after a few transitions. FIG. 2 represents an updated probability distribution after a few transitions. As it can be observed the zone of likely operation of the unknown states narrows and the sizes of the bubbles increase indicating an increased probability of a given state in FIG. 2 when compared to FIG. 1.

FIG. 3 is an example of a 2-D representation of a probability distribution at a mature stage. FIG. 3 represents the probability distribution at a further mature state, where the model has grown further confident in narrowing down the likely operating state of the well to a very specific zone with a high probability.

Step 5—Model Testing and Execution: For testing the model using historical data, the multidimensional probability distribution of the unknown states in the previous time step t[−1] can be used in combination with the values of known surface parameters from time t[0] to predict the expected response of the well at time t[0]. The accuracy of the predicted response compared to the actual measured response is used to test the efficacy of the inverse model. As the model updates the probabilities of unknown states and learns over time, it can be expected that the model will improve its performance progressively as the well undergoes several transitions.

The model can be updated in real time using a live data stream from field sensors. In order to predict the performance of a well in a future state, the trained inverse model can be executed using the multidimensional probability distribution of the unknown states from the current time step t[0] in combination with an input of the current surface parameters from time step t[0], to predict the response of the well at a future time step t[1].

The model obtained through such a procedure as described in this invention can be used for several purposes which may include but are not restricted to:

- Parametric analysis for recommending set-point changes to optimize well performance
- Estimating Flowing Bottomhole Pressure (FBHP) and Tubing Friction Factor
- Utilizing the high-granularity production and sensor data along with predicted FBHP to perform rate transient analysis
- Estimating IPR (inflow performance relationship) from predicted FBHP, and production data
- Estimating reservoir pressures to identify reservoir pressure distributions across the field to select candidate locations for infill drillings
- Recommend re-stimulation on wells which indicate a faster drop in productivity index when compared to near-by wells
- Export simulation model with the highest likely underlying state to perform engineering analysis and for synthetic event generation.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A method of improving performance of a well through improved utilization of computer simulations, comprising iterating the following steps:

- step 1—using first sensor data to identify a first period of time during which a first value of a first surface data is stable;
- step 2—using (a) the first surface data, (b) first historical production data, and (c) a first physics-based simulation to generate a first set of probabilities for a set of possible values for an unknown downhole condition;
- step 3—using probabilistic inverse modeling to estimate a first likelihood that at least some of the set of possible values match with the first set of historical production data;
- step 4—using second sensor data, different from the first sensor data, to identify a second period of time during which a second value of a second surface data is stable; using (a) the second surface data, (b) second historical production data, and (c) a second physics-based simulation to generate probabilities for a second set of probabilities for the set of possible values for the unknown downhole condition; and estimating a drift by comparing the first and second sets of probabilities;
- step 5—using a direction and a magnitude of the drift to avoid unphysical probabilities in the unknown downhole condition, and establish a constraint about a recommendation to improve performance of the well; and
- step 6—improving performance of the well by implementing the recommendation.

2. The method of claim 1, wherein the first sensor data is at least partially historical.

3. The method of claim 1, wherein the first sensor data is at least partially live.

4. The method of claim 1, wherein steps 1-3 of the method are completely automated.

5. The method of claim 1, further comprising eliminating noise from the first surface data.

6. The method of claim 1, wherein the step of estimating the drift further comprises incorporating a change in at least one of an artificial lift setpoint and a transitionary state.

7. The method of claim 1, further comprising constraining the direction of drift to avoid unphysical changes in unknown parameters.

8. The method of claim 1, wherein the second period is a next contiguous stable period after the first period.

9. The method of claim 1, wherein the first physics-based simulation comprises a machine learning proxy.

10. The method of claim 1, comprising utilizing the drift to update the probabilistic inverse modeling.

11. The method of claim 1, wherein the unknown downhole condition comprises at least a reservoir pressure.

12. The method of claim 1, wherein the unknown downhole condition comprises at least a tubing friction factor.

13. The method of claim 1, wherein the recommendation is to re-stimulate the well.

* * * * *